US008546775B2

(12) United States Patent
Kleinschmidt

(10) Patent No.: US 8,546,775 B2
(45) Date of Patent: Oct. 1, 2013

(54) METHOD AND ARRANGEMENT FOR THE STABILIZATION OF THE SOURCE LOCATION OF THE GENERATION OF EXTREME ULTRAVIOLET (EUV) RADIATION BASED ON A DISCHARGE PLASMA

(75) Inventor: Juergen Kleinschmidt, Jena (DE)

(73) Assignee: XTREME technologies GmbH, Aachen (DE)

( * ) Notice: Subject to any disclaimer, the term of this patent is extended or adjusted under 35 U.S.C. 154(b) by 48 days.

(21) Appl. No.: 13/291,171

(22) Filed: Nov. 8, 2011

(65) Prior Publication Data

US 2012/0112101 A1 May 10, 2012

(30) Foreign Application Priority Data

Nov. 10, 2010 (DE) ..... 10 2010 050 947

(51) Int. Cl.
*G21K 5/00* (2006.01)

(52) U.S. Cl.
USPC ..... 250/504 R

(58) Field of Classification Search
USPC ..... 250/504 R
See application file for complete search history.

(56) References Cited

U.S. PATENT DOCUMENTS

| | | | | |
|---|---|---|---|---|
| 6,815,900 | B2 | 11/2004 | Ahmad et al. | |
| 7,541,604 | B2 | 6/2009 | Goetze et al. | |
| 7,683,355 | B2 * | 3/2010 | Moriya et al. | 250/504 R |
| 8,017,924 | B2 * | 9/2011 | Bykanov et al. | 250/504 R |
| 8,179,519 | B2 * | 5/2012 | Stuetzle | 355/52 |
| 8,283,643 | B2 * | 10/2012 | Partlo et al. | 250/504 R |
| 2005/0274912 | A1 * | 12/2005 | Hergenhan et al. | 250/504 R |
| 2006/0192156 | A1 | 8/2006 | Hasegawa | |
| 2006/0219957 | A1 * | 10/2006 | Ershov et al. | 250/504 R |
| 2007/0040511 | A1 * | 2/2007 | Ziener et al. | 315/111.21 |
| 2008/0073598 | A1 * | 3/2008 | Moriya et al. | 250/504 R |
| 2010/0117009 | A1 * | 5/2010 | Moriya et al. | 250/504 R |
| 2010/0127191 | A1 * | 5/2010 | Partlo et al. | 250/504 R |
| 2012/0012762 | A1 * | 1/2012 | Nowak et al. | 250/504 R |

FOREIGN PATENT DOCUMENTS

| | | | |
|---|---|---|---|
| DE | 10314849 | B3 | 12/2004 |
| DE | 102009044426 | A1 | 5/2010 |
| DE | 102005039849 | B4 | 1/2011 |

* cited by examiner

*Primary Examiner* — Robert Kim
*Assistant Examiner* — Wyatt Stoffa
(74) *Attorney, Agent, or Firm* — Patentbar International P.C.

(57) ABSTRACT

The invention is directed to a method and an apparatus for stabilizing the source location during the generation of EUV radiation based on a discharge plasma. The object of finding a novel possibility for stabilizing the source location during the generation of EUV radiation which allows changes in position of the source location to be compensated in a simple manner during the operation of the radiation source is met according to the invention in that a first beam aligning unit (7), a second beam aligning unit (4), and a beam focusing unit (5) are arranged in the vaporization beam (3) and are connected to first to third measuring devices (8, 9, 10) and can be adjusted in order to acquire and compensate for direction deviations and divergence deviations of the vaporization beam (3) with respect to reference values.

16 Claims, 7 Drawing Sheets

METHOD AND ARRANGEMENT FOR THE STABILIZATION OF THE SOURCE LOCATION OF THE GENERATION OF EXTREME ULTRAVIOLET (EUV) RADIATION BASED ON A DISCHARGE PLASMA

RELATED APPLICATIONS

This application claims priority to German Patent Application No. DE 10 2010 050 947.7, filed Nov. 10, 2010, which is incorporated herein by reference in its entirety.

FIELD OF THE INVENTION

The invention is directed to a method and an apparatus for stabilizing the source location during the generation of extreme ultraviolet (EUV) radiation based on a discharge plasma, wherein a vaporization beam of a pulsed high-energy radiation is directed via a beam focusing unit to a predetermined vaporization location for the vaporization of an emitter material between two electrodes of a vacuum chamber.

The invention is applied particularly in semiconductor lithography and is preferably suitable for EUV lithography in the spectral band of 13.5±0.135 nm.

BACKGROUND OF THE INVENTION

For the generation of an EUV radiation by means of a discharge plasma, it is known (e.g., U.S. Pat. Nos. 7,541,604; 6,815,900) to vaporize a suitable emitter material, e.g., tin, in a vacuum chamber by means of a focused, pulsed, high-energy radiation (vaporization beam), e.g., laser radiation, between two electrodes in a vaporization location and to convert the emitter material into a discharge plasma by means of a pulsed electric discharge between the electrodes. The volume in which the discharge plasma is generated and from which EUV radiation is emitted is the source location.

For many applications of EUV radiation, e.g., for microlithography, a consistent quality of the supplied EUV radiation is highly important.

In this connection, even slight changes in the position of the source location between the individual EUV beam pulses can have a very negative effect on the quality of the EUV applications.

SUMMARY OF THE INVENTION

It is the object of the invention to find a novel possibility for stabilizing the source location during the generation of extreme ultraviolet (EUV) radiation based on a discharge plasma which allows heat-dependent changes in position of the source location to be compensated in a simple manner during the operation of the radiation source.

In a method for the stabilization of the source location during the generation of extreme ultraviolet (EUV) radiation based on a discharge plasma, wherein a vaporization beam of a pulsed high-energy radiation is directed via a beam focusing unit to a predetermined vaporization location for the vaporization of an emitter material between two electrodes of a vacuum chamber, the above-stated object is met through the following steps:

first actual direction values of the vaporization beam are acquired in two coordinates prior to impingement on a first beam aligning unit, and the acquired actual direction values are compared with first reference direction values for determining first direction deviations;

a positional correction of a second beam aligning unit in two coordinates is carried out to compensate for the first direction deviations of the vaporization beam;

second actual direction values of the vaporization beam are acquired in two coordinates downstream of the first beam aligning unit, and the acquired second actual direction values are compared with second reference direction values for determining second direction deviations in the direction of the predetermined vaporization location;

a positional correction of the first beam aligning unit in two coordinates is carried out to compensate for the second direction deviations of the vaporization beam;

actual divergence values of the vaporization beam are acquired downstream of the first beam aligning unit, and the acquired actual divergence values are compared with reference divergence values by which the vaporization beam is focused along the corrected direction of the vaporization beam in the predetermined vaporization location for determining divergence deviations; and the beam focusing unit is corrected to compensate for the divergence deviations so that a focusing of the vaporization beam in the vaporization location is adjusted.

By "vaporization location" is meant an area on the surface of one of the electrodes, or an area between the electrodes, in which a supplied emitter material is vaporized through the action of the vaporization beam.

By "actual values" is meant hereinafter those values of the vaporization beam which are actually measured at a location in the vaporization beam. Reference values are values by which the focus of the vaporization beam is directed in the vaporization location with the desired accuracy and energy distribution, i.e., for example, by which a reliable and sufficient vaporization of the emitter material is ensured.

In an advantageous embodiment of the method according to the invention, correction adjustments of the first beam aligning unit, second beam aligning unit, and beam focusing unit are acquired for different first to nth electric input powers of the radiation source as adjustment quantities at which the reference values are achieved and are stored so as to be associated with the first to nth electric input powers so that if the electric input powers of the radiation source change these adjustment quantities can be retrieved and used for alignment, e.g., as basic settings for the alignment.

Correction adjustments are relative positions and orientations such as, e.g., positions in a coordinate system and positional angles of the first beam aligning unit, second beam aligning unit, and beam focusing unit.

This procedure offers the advantage that when one of the various preadjusted first to nth electric input powers of the radiation source is selected, a fast first adjustment of the direction and divergence of the vaporization beam is achieved starting from the respective basic setting following a change in the radiation output. The deviations in direction and divergence can be compensated in a precise manner starting from the respective basic setting.

In a preferred embodiment of the method, correction adjustments of position-sensitive sensors which are used for acquiring the first actual direction values, second actual direction values and actual divergence values are acquired for various (first to nth) electric input powers of the radiation source and are stored so as to be associated with the first to nth radiation outputs so that they can be retrieved and used for adjustment when there are changes in the electric input power of the radiation source.

When selecting one of the first to nth electric input powers, the respective stored adjustment quantities for the position-sensitive sensors are automatically retrieved and the adjustment quantities of the position-sensitive sensors are adjusted as basic settings.

The determination, storage and adjustment of the correction adjustments of the first beam aligning unit, second beam aligning unit and beam focusing unit can be combined with a determination, storage and adjustment of the correction adjustments of the position-sensitive sensors used for acquiring the first actual direction values, second actual direction values and actual divergence values.

The correction adjustments of the first beam aligning unit, second beam aligning unit and beam focusing unit and of the position-sensitive sensors are determined under standardized conditions and stored in a database, preferably an electronic database, in the simplest case in a table. Standardized conditions can be established, for example, through the selection of a determined electric input power for calibration and through standardized ambient temperatures.

The first to nth electric input powers can be freely selected.

The vaporization location can be established at different positions between the electrodes depending upon the embodiment of the method according to the invention. An emitter material is supplied in the vaporization location, for example, inserted, arranged on the surface of a carrier therein, or thrown into or allowed to fall into the vaporization location.

In a first embodiment, the vaporization beam is focused in a vaporization location located on the surface of an electrode which is coated with the emitter material. The electrode can be moved in the vaporization location. For example, it can be constructed as a rotating electrode and can rotate in the vaporization location, execute a partial orbit, or be moved linearly through the vaporization location as is the case, for example, with circulating ribbon electrodes.

In another embodiment of the method, it is possible that the vaporization beam is focused as vaporization beam in a vaporization location between the electrodes, and drops of emitter material are injected regularly (and so as to be synchronized with the electric discharge) into the vaporization location.

In this embodiment, the emitter material is also moved in the vaporization location, for example, in that it is introduced into the vaporization location, shot into the vaporization location by a droplet generator, or falls into the vaporization location by the force of gravity.

Further, the method is carried out in such a way that a distance between the vaporization location and at least one reference point is monitored by means of an optical distance monitoring device. An optical distance monitoring of this type can be carried out, e.g., by means of a laser distance sensor.

The selected radiation for the vaporization beam can be a high-energy radiation such as laser radiation or a particle beam supplied by a radiation source.

In an arrangement for the stabilization of the source location during the generation of extreme ultraviolet (EUV) radiation based on a discharge plasma, wherein a radiation source for generating a vaporization beam of pulsed high-energy radiation as vaporization beam is directed via at least a first beam aligning unit and a beam focusing unit to a predetermined vaporization location for vaporization of an emitter material between two electrodes for the gas discharge in a vacuum chamber, the above-stated object is met further in that a second beam aligning unit is arranged in front of the beam focusing unit and a first beam aligning unit is arranged behind the beam focusing unit in the vaporization beam, a first beamsplitter for coupling out a first beam component of the vaporization beam to a first measuring device for acquiring direction deviations of the vaporization beam is arranged in the vaporization beam in front of the second beam aligning unit, and the first measuring device is connected to a storage/control unit and to adjusting means by which the position and orientation of the second beam aligning unit can be adjusted, a second beamsplitter for coupling out a second beam component of the vaporization beam to a second measuring device for acquiring direction deviations of the vaporization beam from reference values in direction of the vaporization location is arranged behind the first beam aligning unit in the vaporization beam focused in the vaporization location, wherein the second measuring device is connected to the storage/control unit and to adjusting means by which the position and orientation of the first beam aligning unit can be adjusted, a third beamsplitter for coupling out a third beam component of the vaporization beam to a third measuring device for acquiring divergence deviations of the vaporization beam from reference divergence values in direction of the vaporization location is arranged behind the first beam aligning unit in the vaporization beam focused in the vaporization location, wherein the third measuring device is connected to the data storage and to adjusting means by which the beam focusing unit can be adjusted for generating a focus of the vaporization beam in the predetermined vaporization location, and the first beam aligning unit, second beam aligning unit, beam focusing unit, first beamsplitter, second beamsplitter and third beamsplitter are fixedly mechanically connected to the vacuum chamber.

In an advantageous embodiment, the second beam aligning unit is constructed as a direction manipulator of the radiation source for the pulsed high-energy radiation and the first beam aligning unit is constructed in such a way that it causes a beam deflection. For example, the direction manipulator can be optics which are adjustable in two dimensions and which are arranged in front of the radiation source. The beam aligning units can be mirrors, for example.

The radiation source, the beam directing units, the beam focusing unit, the measuring devices, data storage, adjusting means, and the storage/control unit are preferably arranged outside the vacuum chamber.

Further, the first beam aligning unit and second beam aligning unit can be constructed as two-dimensionally adjustable beam deflecting units. Accordingly, the latter can be connected to adjusting means which make it possible to adjust the direction of the vaporization beam in an x-y plane in the vaporization location, and the first beam aligning unit and second beam aligning unit can be adjusted in a corresponding manner with respect to position and orientation.

The beamsplitters can be beamsplitter minors, beamsplitter cubes, but also rotating laser windows. Rotating laser windows reflect at least some of the radiation of the vaporization beam on at least one of the first to third measuring devices at least periodically.

The first measuring device and second measuring device are advantageously position-sensitive radiation sensors for detecting a positional deviation as an equivalent measured quantity for acquiring the direction deviation from a reference direction value.

These position-sensitive radiation sensors can be formed in each instance by a receiver unit chosen from the group comprising matrix detectors, quadrant detectors, combinations of two bi-cell detectors arranged orthogonal to one another, or combinations of two line detectors arranged orthogonal to one another. The position-sensitive radiation sensors can communicate with displacing means by which the position-sensitive radiation sensors can be adjusted in a controlled manner with respect to their relative position and orientation.

By "bi-cell detectors" is meant hereinafter all detectors comprising two sensors, e.g., as in a dual photodiode. When bi-cell detectors are used as detectors, additional beamsplitters are advantageously arranged in front of the bi-cell detectors.

In a preferred embodiment, the third measuring device has a mirror with an opening, e.g., an aperture minor having a central aperture, to which is directed the third beam component coupled out of the vaporization beam. Further, a first sensor is provided for detecting the radiation passing the aperture of the mirror and a second sensor is provided for detecting the radiation of the third beam component reflected by the minor.

In another embodiment of the arrangement, a rotating laser window is arranged in the vaporization beam as second beamsplitter through which radiation of the vaporization beam is reflected at least periodically onto the second measuring device and the third measuring device.

In other embodiments, the arrangement can also comprise additional measuring devices, e.g., such as means for optical distance monitoring of areas of the surface of at least one of the electrodes, e.g., of the vaporization location, from a reference point.

The core of the method according to the invention consists in a comparison between the actual values and reference values of the direction of a vaporization beam and of the divergence of a vaporization beam, which comparison is also possible during the operation of an installation for generating EUV radiation, and in the compensation of deviations between actual values and reference values. A stabilization of the source location is achieved by means of stabilizing the spatial position of the vaporization location.

One reason for the relative instability of the source location on the arrangement side is that thermal stresses are brought about in the vacuum chamber and in the optical elements arranged in and at the vacuum chamber as a result of the considerable heat development during the high-frequency generation of discharge plasmas. Owing to these thermal stresses, the optical elements change position relative to one another so that the focus of the vaporization beam is directed into the vaporization location with variable accuracy and degree of focusing.

This relates, e.g., to the cooling capacity, i.e., the power dissipated in the system that can be carried off by means of cooling. As a result of the spatial separation of dissipated power and heat dissipation which, although small, is always present, temperature gradients always occur. These temperature gradients are the real causes of thermomechanically dependent deformations of the relevant components.

The optical path of the vaporization beam is usually adjusted with a "cold" EUV source, i.e., at comparatively low electric input powers of the radiation source, e.g., at 50 kW. However, the corresponding input powers for radiation sources in the actual application are often appreciably greater than the radiation outputs used for the adjustment. Consequently, deviations from the adjusted state occur when used with higher electric input powers, which can result in an unstable source location.

The method according to the invention is based on the assumption that the thermomechanically dependent changes in position are reversible, i.e., the original position is resumed upon return to the original temperature as is the case in good approximation when changes in position occur due to heating of the vacuum chamber and of the elements arranged in and at the vacuum chamber.

BRIEF DESCRIPTION OF THE DRAWINGS

The invention will be described more fully in the following with reference to drawings and embodiment examples. The drawings show.

DETAILED DESCRIPTION OF THE PREFERRED EMBODIMENTS

Figure 1:
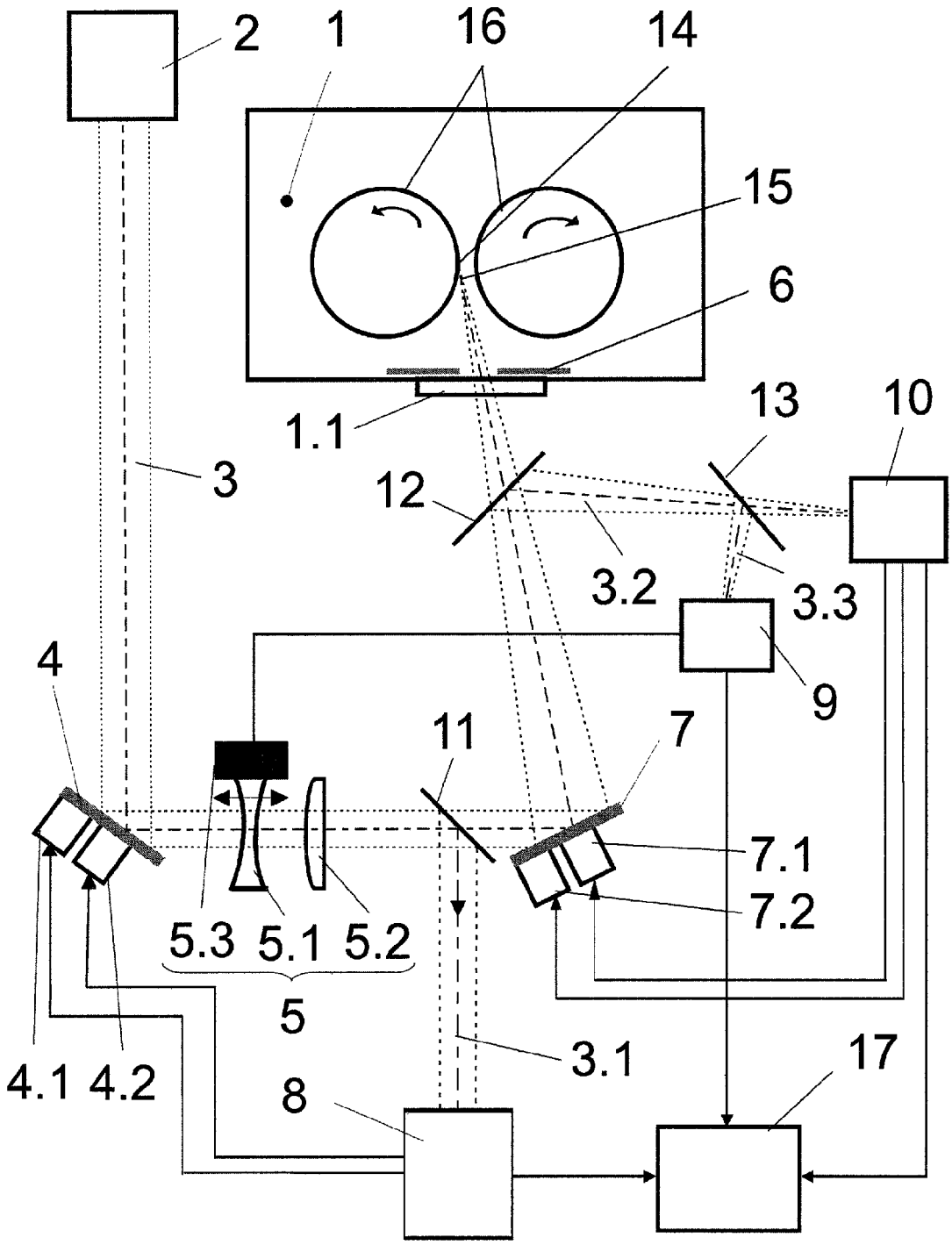
FIG. 1 a first arrangement according to the invention having a radiation source and two beam directing units.

The essential elements in an arrangement according to the invention shown in FIG. 1 are a vacuum chamber 1, a radiation source 2 for supplying a vaporization beam 3 of a pulsed high-energy radiation, a first beam directing unit 7, a second beam directing unit 4, and a beam focusing unit 5 in the vaporization beam 3 between the second beam directing unit 7 and first beam directing unit 4, and, further, a first measuring device 8 and a second measuring device 9 for acquiring direction deviations of the vaporization beam 3, and a third measuring device 10 for acquiring divergence deviations of the vaporization beam 3.

Two electrodes 16 which are constructed as rotating electrodes are provided in the vacuum chamber 1. An emitter material (not shown) is continuously supplied on the surface of the electrode 16 functioning as cathode. The vaporization beam 3 can be coupled into the vacuum chamber 1 through an input window 1.1 in a wall of the vacuum chamber 1.

The first beam directing unit 7, the second beam directing unit 4, the beam focusing unit 5, the first measuring device 8, the second measuring device 9, and the third measuring device 10 are arranged outside the vacuum chamber 1 and are mechanically fixedly connected to the vacuum chamber 1.

The radiation is supplied by the radiation source 2 which is constructed as a laser radiation source and is directed to the second beam directing unit 4 as a vaporization beam 3. The second beam directing unit 4 is constructed as a high-reflectivity mirror (>99% HR mirror) which can be tilted in two dimensions by adjusting means 4.1 and 4.2 in such a way that the vaporization beam 3 is guided in direction of the first beam directing unit 7 by the beam focusing unit 5, which is constructed as a telescope, and impinges centrally on this first beam directing unit 7.

The beam focusing unit 5 has a concave lens 5.1 and a convex lens 5.2 which serve to correct the divergence of the vaporization beam 3 in such a way that the centroid of the intensity distribution can be adjusted in a focus 15 with an accuracy of <25 μm. One of the two lenses 5.1, 5.2 (in this case, the concave lens 5.1) can be displaced relative to the convex lens 5.2 by adjusting means 5.3.

Through the beam focusing unit 5, the vaporization beam 3 can be focused in a z direction facing along the vaporization beam 3 in the vaporization location 14 and perpendicular to an x-y plane extending perpendicular to the vaporization beam 3.

Through the first beam directing unit 7, the focused vaporization beam 3 is directed through an effective stop 6 into the vaporization location 14 which is located on the surface of an electrode 16 provided with an emitter material. The vaporization beam 3 can be delivered to the vaporization location 14 by means of the first beam directing unit 7 at x and y coordinates defined in the x-y plane.

The stop 6 is determined through openings in an existing debris mitigation tool and through possible shading of the vaporization beam 3 between input window 1.1 and vaporization location 14.

A first beamsplitter 11, designed as a beamsplitter mirror, for coupling out a first beam component 3.1 of the vaporization beam 3 to the first measuring device 8 for acquiring direction deviations of the vaporization beam 3 is arranged in the vaporization beam 3 in front of the first beam directing unit 7. The first measuring device 8 is connected to a storage/control unit 17 and to the adjusting means 4.1, 4.2 by which the position and orientation of the second beam aligning unit 4 can be adjusted.

A second beamsplitter 12 for coupling out a second beam component 3.2 of the vaporization beam 3 to a second measuring device 9 for acquiring direction deviations of the vaporization beam 3 from reference values in direction of the vaporization location 14 is arranged behind the first beam aligning unit 7 in the vaporization beam 3 which is focused in the vaporization location 14. The second measuring device 9 is likewise connected to the storage/control unit 17 and to adjusting means 7.1, 7.2 of the first beam aligning unit 7 by means of which the position and orientation of the first beam aligning unit 7 can be adjusted.

A third beamsplitter 13 for coupling out a third beam component 3.3 of the vaporization beam 3 to a third measuring device 10 for acquiring divergence deviations of the vaporization beam 3 from reference divergence values in direction of the vaporization location 14 is arranged in the second beam component 3.2. The third measuring device 10 is connected to the storage/control unit 17 and to the adjusting means 5.3 of the beam focusing unit 5, by means of which the beam focusing unit 5 can be adjusted for generating a focus 15 of the vaporization beam 3 in the predetermined vaporization location 14. A third beam component 3.3 is coupled out of the second beam component 3.2 by the third beamsplitter 13 and is directed to the third measuring device 10.

In another embodiment of the invention, the third beamsplitter 13 can also be arranged directly in the vaporization beam 3.

The first to third beamsplitters 11, 12, 13 are glass or fused quartz plates having an AR (anti-reflection) coating on one side which reflect a small portion of the radiation—between 0.5% and 4%—in direction of the first, second and third measuring device 8, 9, 10, respectively.

Figure 2:
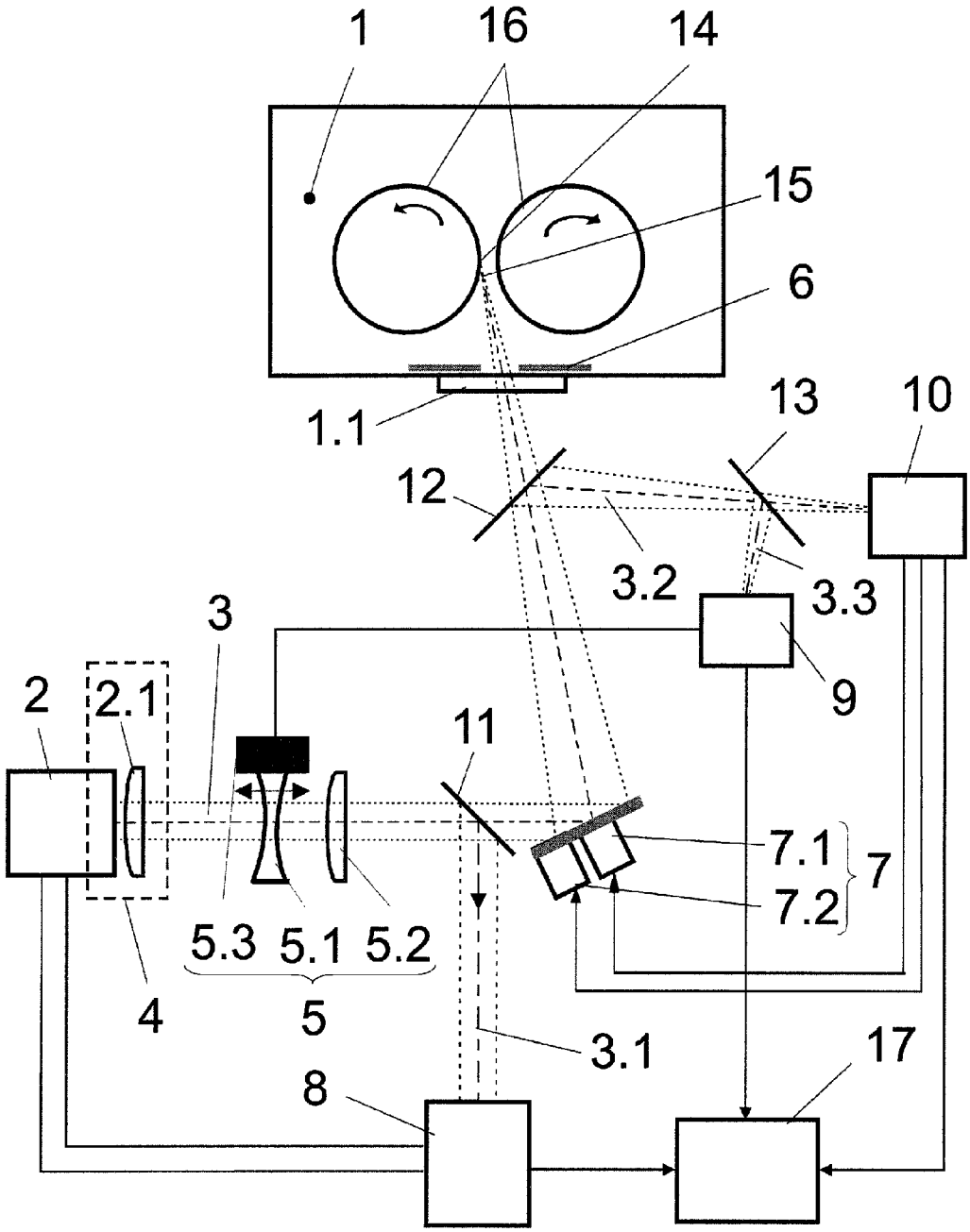
FIG. 2 a second arrangement according to the invention having direction manipulator arranged in front of a radiation source and two beam directing units.

In a second embodiment of the arrangement according to the invention shown in FIG. 2, the radiation source 2 is arranged outside the vacuum chamber 1 in such a way that the vaporization beam 3 is guided directly to the beam focusing unit 5 and the first beam directing unit 7. The second beam directing unit 4 is constructed as a direction manipulator of the radiation source 2 and, specifically, is arranged in front of the radiation source 2 as optics 2.1 which are adjustable in two dimensions.

In a modified embodiment of the radiation source 2, the second beam directing unit 4 can also include an adjustable deflecting element according to FIG. 1 in addition to the two-dimensionally adjustable optics 2.1.

The first measuring device 8 and the second measuring device 9 are constructed as position-sensitive radiation sensors for acquiring direction deviations of the vaporization beam 3 from predetermined reference direction values. The first measuring device 8 and the second measuring device 9 each include a receiver unit which comprises two receiver elements arranged orthogonal to one another.

Figure 3:
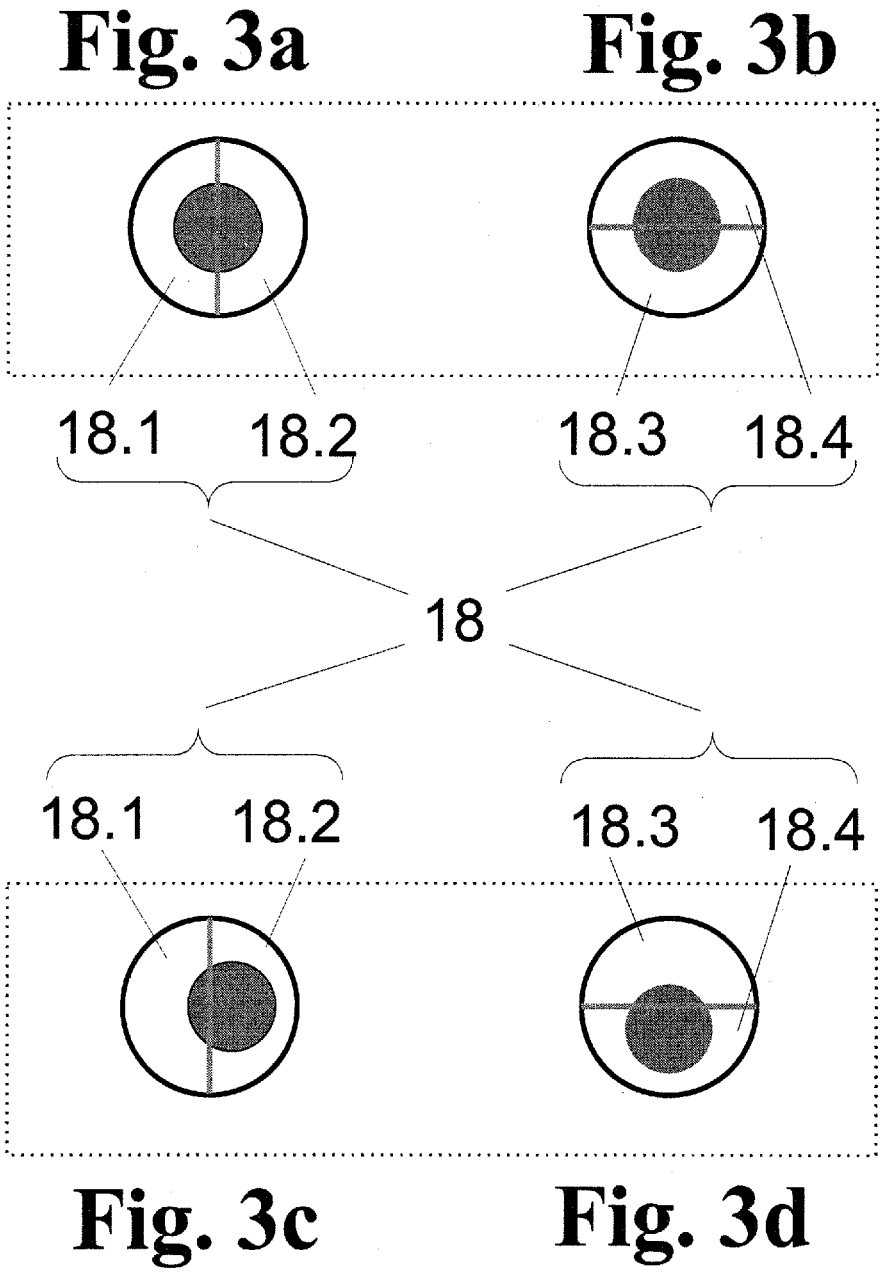
FIG. 3 an arrangement of dual photodiodes in the following states: 3*a*) aligned in x direction; 3*b*) aligned in y direction; 3*c*) out of alignment in x direction; 3*d*) out of alignment in y direction.

FIG. 3 shows bi-cell detectors 18 as receiver unit. Each of these bi-cell detectors 18 is constructed as a dual photodiode with photodiodes 18.1, 18.2 and 18.3, 18.4 as receiver elements. The bi-cell detector 18 with photodiodes 18.1 and 18.2 which is shown in FIG. 3*a* is used for acquiring a position of the vaporization beam 3 in direction of the x axis of the x-y plane, while the bi-cell detector 18 with photodiodes 18.3 and 18.4 which is shown in FIG. 3*c* is used for acquiring a position of the vaporization beam 3 in direction of the y axis of the x-y plane. The bi-cell detectors 18 of FIGS. 3*a* and 3*c* and FIGS. 3*b* and 3*d* form, respectively, a position-sensitive radiation sensor each having two receiver elements arranged orthogonal to one another. The bi-cell detectors 18 are each connected (not shown) to displacing means by means of which the bi-cell detectors 18 can be adjusted individually. The displacing means are connected to the storage/control unit. In the first measuring device 8 and in the second measuring device 9, at least one additional beamsplitter (not shown) is arranged, respectively, in the first beam component 3.1 and in the second beam component 3.2, the respective partial beams thereof being directed to a bi-cell detector 18 having photodiodes 18.1 and 18.2 and photodiodes 18.3 and 18.4, respectively.

In FIGS. 3*a* and 3*c*, the first beam component 3.1 impinges on the bi-cell detector 18 symmetrically with respect to a center line between the photodiodes 18.1 and 18.2. In an illumination scenario of this kind, the actual direction values of the vaporization beam 3 conform to the reference direction values. In FIGS. 3*b* and 3*d*, the first beam component 3.1 impinges asymmetrically with respect to a center line between the photodiodes 18.3 and 18.4.

Figure 4:
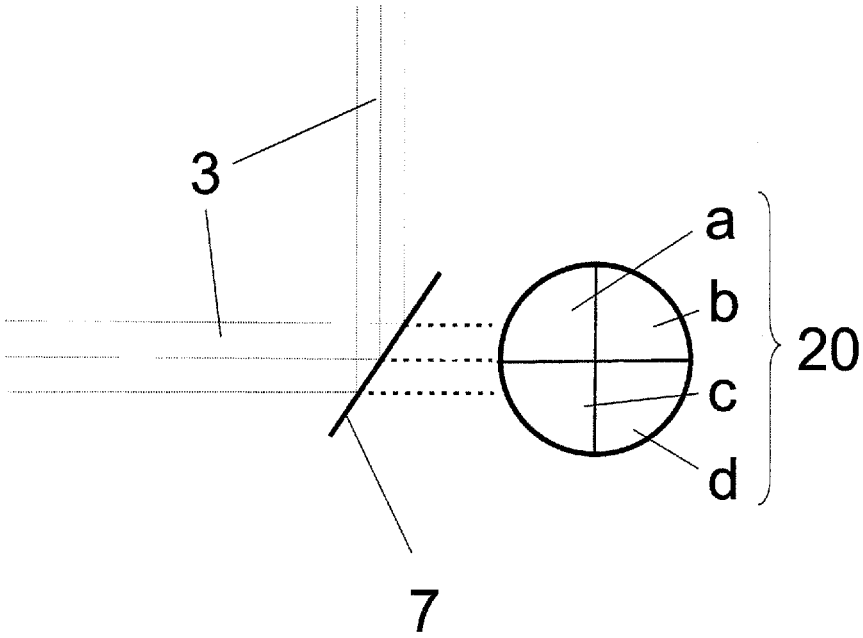
FIG. 4 a third measuring device for acquiring divergence deviations.

In another embodiment of the arrangement according to the invention shown in FIG. 4, the first measuring device 8 is arranged behind the first beam directing unit 7 in such a way that the beam components which are not reflected and which penetrate through the first beam directing unit 7 impinge on a quadrant photodiode 17 having photodiodes a, b, c and d as receiver unit. In this embodiment, the first beam directing unit 7 takes over the function of the first beamsplitter 11.

In further embodiments, other suitable reception units such as matrix detectors, a combination of two bi-cell detectors which are arranged orthogonal to one another, or a combination of two line detectors which are arranged orthogonal to one another can also be used in the first measuring device 8 and second measuring device 9 instead of a quadrant photodiode 17 or dual photodiodes.

Figure 5:
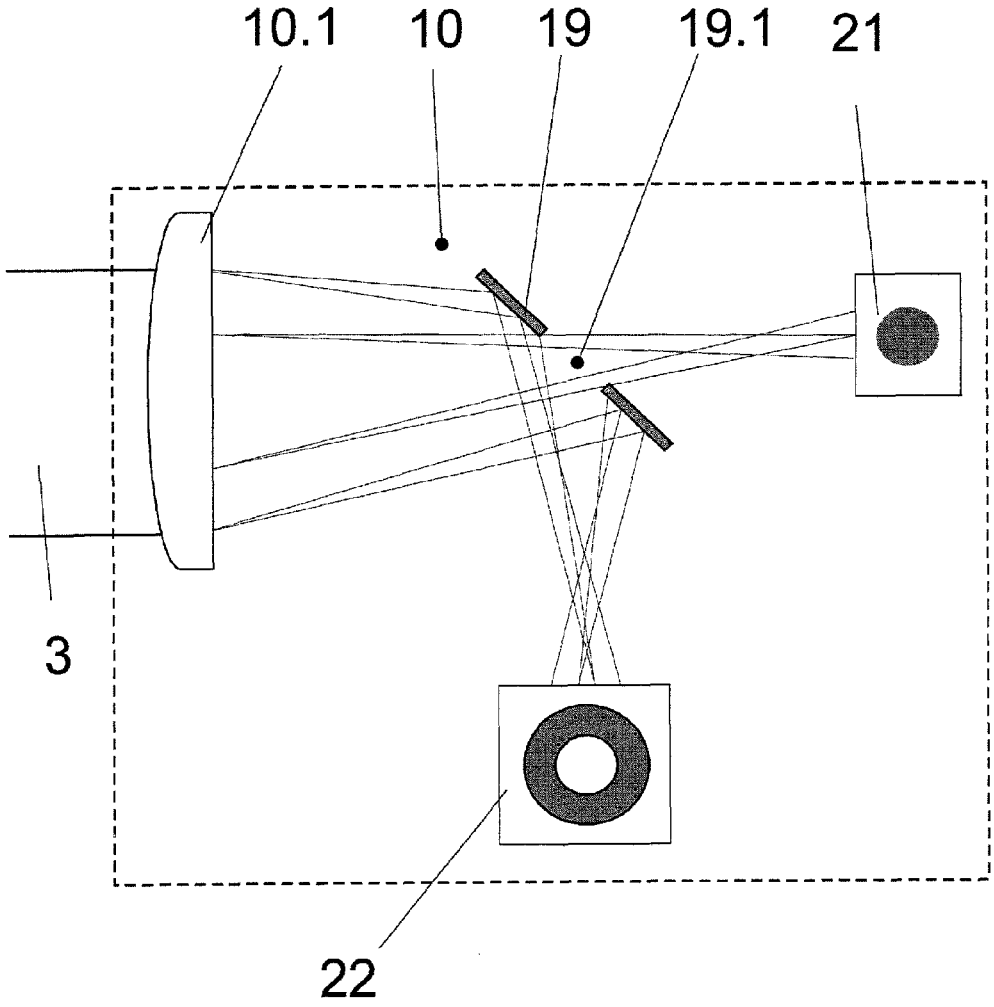
FIG. 5 an arrangement of a quadrant detector behind a HR mirror.

The construction of the third measuring unit 10 is shown schematically in FIG. 5. The third beam component 3.3 which is coupled out of the second beam component 3.2 as is shown in FIGS. 1 and 2 is focused on an aperture minor 19 (as HR mirror) having a circular, central aperture 19.1 by means of a convex lens 10.1. A portion of the third beam component 3.3 passes through the aperture 19.1 and impinges on a photodiode which is arranged behind the aperture minor 19 as a first divergence sensor 21. The portion of the third beam component 3.3 impinging on the aperture mirror 19 is reflected by the aperture mirror 19 onto a second photodiode as second divergence sensor 22.

The aperture angle of the vaporization beam of the third beam component 3.3 is enlarged inside the third measuring unit 10 through the convex lens 10.1. If the position of the focus 15 of the vaporization beam 3 changes, the diameter of the third beam component 3.3 changes so that the latter in turn impinges on the third measuring device 10 with the changed diameter. As a result, the beam components which are acquired by the first divergence sensor 21 and the second divergence sensor 22 also change because the third beam component 3.3 focused on the aperture minor 19 also has a changed diameter.

For example, if the focus of the third beam component 3.3 moves away from the convex lens 10.1 of the third measuring device 10, the diameter of the vaporization beam of the third beam component 3.3 at the aperture mirror 19 becomes larger so that more beam components are reflected to the second divergence sensor 22. Correspondingly fewer beam components reach the first divergence sensor 21. The reverse case occurs when the focus is displaced toward the convex lens 10.1.

Figure 6:
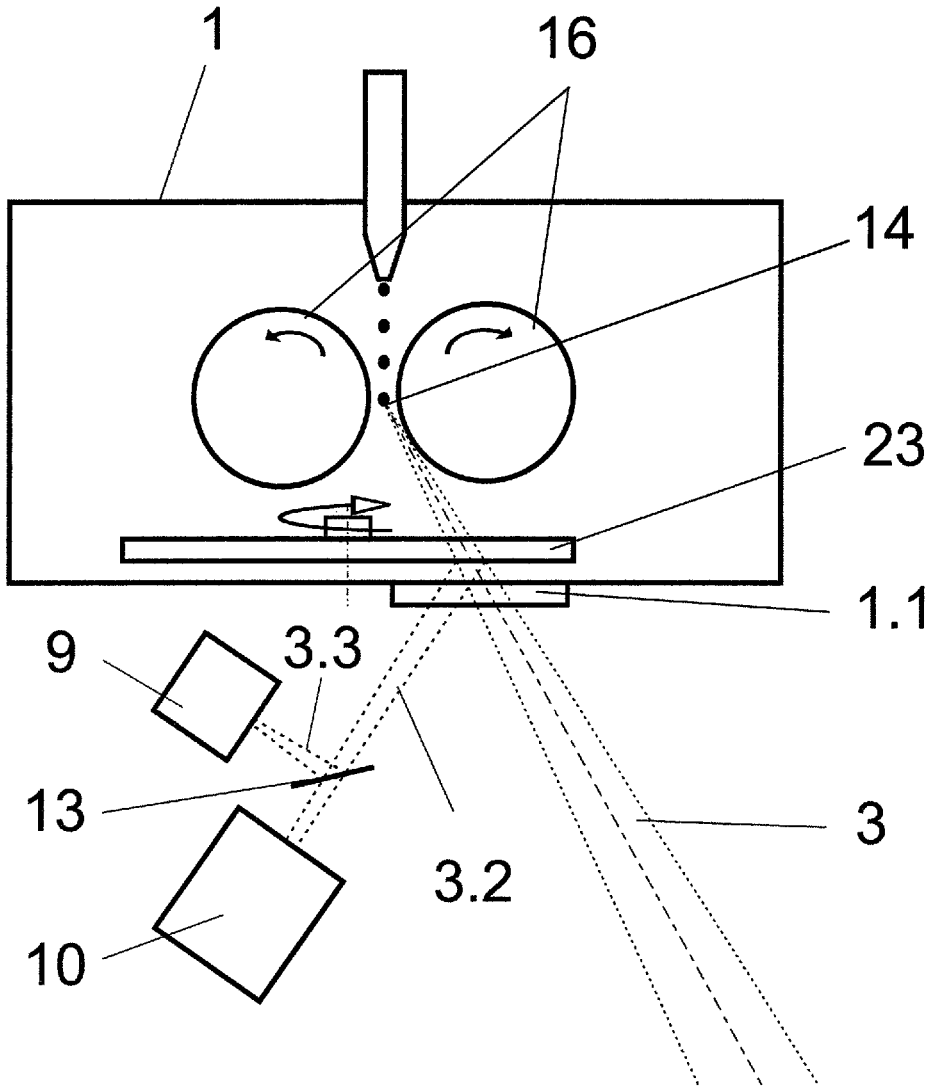
FIG. 6 an arrangement having a rotating laser window and emitter material injected between the electrodes.

As is shown in FIG. 6, the second beamsplitter 12 can also be formed by a rotating laser window 23 which is provided in the focused vaporization beam 3 between the first beam directing unit 7 and the vaporization location 14. In this case, for an emitter material in the form of droplets (only shown schematically as solid circles) the vaporization location 14 is located between the electrodes 16. A reflection of the vaporization beam 3 is reflected onto the second measuring device 9 at least periodically as a second beam component 3.2 by the rotating laser window 23. The third beam component 3.3 can be coupled out of the second beam component 3.2 and directed to the third measuring device 10.

Figure 7:
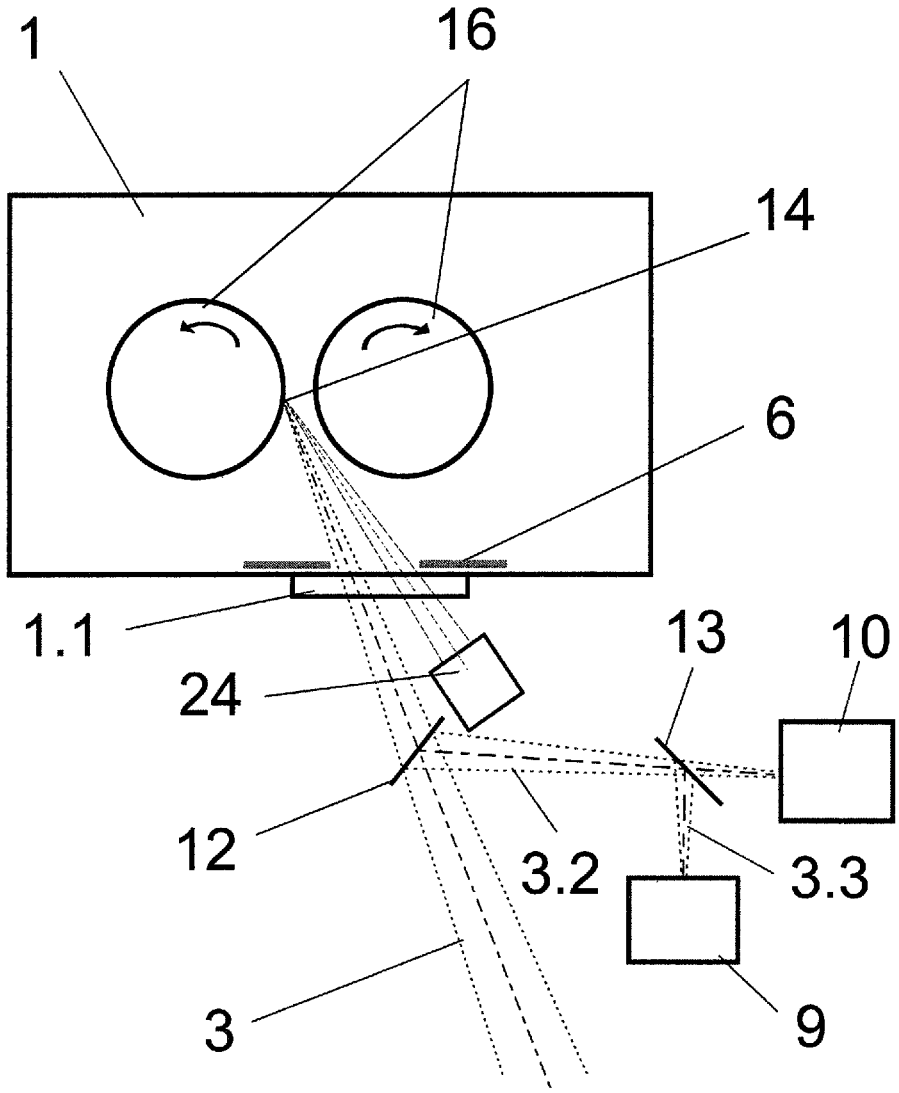
FIG. 7 an arrangement having optical distance monitoring.

FIG. 7 shows an enlarged section (not to scale) from the arrangements according to FIGS. 1 and 2 in which means for optical distance monitoring 24 are provided. The latter measures and monitors a distance of the vaporization location 14 on the surface of one of the electrodes 16 from a reference point, e.g., from the stop 6 or from the means for optical distance monitoring 24. For example, the means for optical distance monitoring 24 can be an optical distance sensor such as a laser distance sensor which operates (digitally) by the triangulation principle and which allows 1500 measured values per second at a response time of 0.6 ms and a measuring frequency of 1.5 kHz. The measurement ranges of the laser distance sensor are between 1 and >1000 mm and have a resolution of 0.006 mm at a distance of 600 mm. At a distance of the laser distance sensor of around 1 m from the vaporization location 14 on the surface of at least one of the electrodes 16, the resolution is around 0.01 mm. The means for optical distance monitoring 23 communicate with the storage/control unit 17.

The method according to the invention will be described in more detail referring to an arrangement according to FIG. 1. In the first measuring device 8 and second measuring device 9, two dual photodiodes are arranged orthogonal to one another as bi-cell detectors 18. The arrangement is to be adjusted for a first electric input power of the radiation source of 20 kW.

A pulsed laser radiation is supplied by the radiation source 2, directed to the second beam directing unit 4, focused in z direction through the beam focusing unit 5, and directed into the vaporization location 14 by the first beam directing unit 7.

By trial-and-error adjustment of the beam focusing unit 5 and of the first beam directing unit 4 and second beam directing unit 7, the arrangement is adjusted to a setting at which a maximum conversion efficiency is achieved.

The first measuring device 8 is arranged in that the bi-cell detector 18 used for acquiring a position of the vaporization beam 3 in direction of the x axis of the x-y plane is positioned in such a way that the first beam component 3.1 impinges symmetrically on the bi-cell detector 18 with respect to a center line between the photodiodes 18.1 and 18.2.

The same positioning is implemented with the second bi-cell detector 18 having photodiodes 18.3 and 18.4 which is used for acquiring a position of the vaporization beam 3 in direction of the y axis of the x-y plane.

When a quadrant photodiode 20 is used instead of two bi-cell detectors 18, the method can be described as follows:

The individual photodiodes a, b, c and d of the quadrant photodiode 20 record the digitized voltage values $S_a$, $S_b$, $S_c$ and $S_d$. When using a 12-bit D-A converter, these values are in the range of (−2047 . . . +2047). These voltage values are proportional to the energies of the radiation of the vaporization beam 3 impinging on the corresponding photodiodes a, b, c and d, respectively. Since a pulse-to-pulse control is not absolutely necessary, sliding averages can be formed over many beam pulses. The goal is to displace the quadrant photodiode 20 laterally to a set position X(set) by means of the displacing means to which the quadrant photodiode 20 is connected. Set position X(set) can also be described by:

$$X(\text{set})=X(\text{actual})+f*[(S_a+S_c)-(S_b+S_d)]/(S_a+S_b+S_c+S_d),$$

where f is a conversion factor between the normed digitized voltage values and the X position values. The desired set position X(set) is achieved when:

$$[(S_a+S_c)-(S_b+S_d)]/(S_a+S_b+S_c+S_d)=0.$$

This set position X(set) for 20 kW power is stored in a file (Table 1) in the storage/control unit 17.

This applies in a corresponding manner to the lateral displacement of quadrant photodiode 20 in y direction:

$$Y(\text{set})=Y(\text{actual})+g*[(S_a+S_b)-(S_c+S_d)]/(S_a+S_b+S_c+S_d),$$

where g is a conversion factor between the normed digitized voltage values and the Y position values. The desired set position Y(set) is achieved when the following condition is met:

$$[(S_a+S_b)-(S_c+S_d)]/(S_a+S_b+S_c+S_d)=0.$$

This set position Y(set) is likewise stored in a file (Table 1) in the storage/control unit 17.

The deviations determined in the x direction and y direction by the first measuring device 8 are the first direction deviations.

The acquired set positions of the measurement devices at a determined electric input power are the correction adjustments of the measuring device.

The process of adjusting the second measuring device 9 by which the second direction deviations are determined is carried out in an entirely corresponding manner.

When adjusting the set position Z(set) in z direction, the goal is to displace the convex lens in the third measuring device 10 relative to the aperture minor 19 in direction of the vaporization beam of the third beam component 3.3 such that the Z set position $$Z(\text{set})=Z(\text{actual})+h*(S_e-S_f)/(S_a+S_f)$$

is achieved when the condition $(S_e-S_f)/(S_a+S_f)=0$ is met, where h is a conversion factor between the normed digitized voltage values and the Z position values. This set position Z(set) is likewise stored in a file (Table 1) in the storage/control unit 17. Divergence deviations are determined by means of the third measuring device 10.

The first to third measuring devices 8 to 10 are set up at all of the first to nth electric input powers of the radiation source 2 which are to be used. All of the determined set positions are stored together with the associated electric input power in a table and, in other embodiments of the method, also in other suitable databases or classification schemes, so as to be repeatedly retrievable.

TABLE 1 consecutive number, electric input power of the radiation source, and set positions of the measuring devices.

| n | electric input power in kW | first measuring device (8) X, Y set position | second measuring device (9) X, Y set position | third measuring device (10) Z set position |
|---|---|---|---|---|
| 1 | 20 | $X_{81}, Y_{81}$ | $X_{91}, Y_{91}$ | $Z_{101}$ |
| 2 | 50 | $X_{82}, Y_{82}$ | $X_{92}, Y_{92}$ | $Z_{102}$ |
| 3 | 100 | $X_{83}, Y_{83}$ | $X_{93}, Y_{93}$ | $Z_{103}$ |
| 4 | 150 | $X_{84}, Y_{84}$ | $X_{94}, Y_{94}$ | $Z_{104}$ |
| 5 | 200 | $X_{85}, Y_{85}$ | $X_{95}, Y_{95}$ | $Z_{105}$ |
| 6 | 250 | $X_{86}, Y_{86}$ | $X_{96}, Y_{96}$ | $Z_{106}$ |

The appropriate set positions are moved to depending on the electric input power at which the arrangement is to be operated.

Moving to the set positions prior to putting the radiation source 2 into operation will not mean that the vaporization beam 3 is aligned. Alignment is carried out by compensating for the first and second direction deviations and the divergence deviations. To align, e.g., at an electric input power of 50 kW, the quadrant photodiode 20 in the first measuring device 8 is advanced to set positions $X_{82}$, $Y_{82}$ which were retrieved from the storage/control unit 17 beforehand.

If the relevant quantity for adjustment in the x direction is:

$$[(S_a+S_c)-(S_b+S_d)]/(S_a+S_b+S_c+S_d)\neq 0,$$

the amount of the deviation from zero is used to determine the quantity of motor steps to be carried out by the x-adjusting means 4.1 of the second beam directing unit 4. The feed direction of the adjusting means 4.1 can likewise be deduced from the mathematical sign of the determined deviation from zero. The second beam directing unit 4 is tilted until:

$$[(S_a+S_c)-(S_b+S_d)]/(S_a+S_b+S_c+S_d)=0.$$

The X direction is then adjusted. The x-adjusting means 4.1 are controlled through the storage/control unit 17.

If the quantity is initially also:

$$[(S_a+S_b)-(S_c+S_d)]/(S_a+S_b+S_c+S_d)\neq 0,$$

the y-adjusting means 4.2 of the second beam directing unit 4 are tilted analogous to the preceding description until:

$$[(S_a+S_b)-(S_c+S_d)]/(S_a+S_b+S_c+S_d)=0.$$

The Y direction is then also aligned. The y-adjusting means 4.2 are controlled through the storage/control unit 17.

The first beam directing unit 7 is adjusted in an analogous manner.

The procedure is analogous with respect to focusing in the z direction. The convex lens in the third measuring device 10 is advanced to its set position $Z_{102}$. The storage/control unit 17 issues a control command to an adjusting means 5.3 of the beam focusing unit 5 on the basis of which the concave lens 5.1 is moved until the condition $(S_e-S_f)/(S_e+S_f)=0$ is met. The feed direction of adjusting means 5.3 can likewise be deduced from the sign of the determined deviation from zero. The focus is then adjusted in Z direction for this input power.

When generating EUV radiation by means of a gas discharge plasma from the vaporized emitter material, a virtually loss-free process is possible through the collector optics (not shown), which collect, shape and direct the EUV radiation, only when the EUV radiation issues from a volume of approximately 200 $mm^3$. Therefore, the vaporization of the emitter material must take place in this volume.

Naturally, it is also possible in a manner analogous the procedure described above to store adjustment quantities of the first beam directing unit 7 and/or second beam directing unit 4 and of the beam focusing unit 5 as correction adjustments so as to be associated with an electric input power and, when selecting one of the first to nth electric input powers, to automatically retrieve the respective stored adjustment quantities for the first beam aligning unit 7, second beam aligning unit 4 and focusing unit 5 and to adjust them as basic settings.

The alignment can now be periodically or permanently repeated and corrected during operation of the arrangement.

The arrangement according to the invention and the method according to the invention can be used in all technical installations in which EUV radiation is generated.

Reference Numerals:

| | |
|---|---|
| 1 | vacuum chamber |
| 1.1 | input window |
| 2 | radiation source |
| 2.1 | two-dimensionally adjustable optics |
| 3 | vaporization beam |
| 3.1 | first beam component |
| 3.2 | second beam component |
| 3.3 | third beam component |
| 4 | second beam directing unit |
| 4.1 | adjusting means (X feed) |
| 4.2 | adjusting means (Y feed) |
| 5 | beam focusing unit |
| 5.1 | concave lens |
| 5.2 | convex lens (of the beam focusing unit) |
| 5.3 | adjusting means (Z feed) |
| 6 | stop |
| 7 | second beam directing unit |
| 7.1 | adjusting means (X feed) |
| 7.2 | adjusting means (Y feed) |
| 8 | first measuring device |
| 9 | second measuring device |
| 10 | third measuring device |
| 10.1 | convex lens (of the third measuring device) |
| 11 | first beamsplitter |
| 12 | second beamsplitter |
| 13 | third beamsplitter |
| 14 | vaporization location |
| 15 | focus |
| 16 | electrode |
| 17 | storage/control unit |
| 18 | bi-cell detector |
| 18.1 and 18.2 | photodiodes (for the x direction) |
| 18.3 and 18.4 | photodiodes (for the y direction) |
| 19 | aperture mirror |
| 19.1 | aperture |
| 20 | quadrant photodiode |
| a to d | photodiodes (of a quadrant photodiode) |
| 21 | first divergence sensor |
| 22 | second divergence sensor |
| 23 | rotating laser window |
| 24 | means for optical distance monitoring |

What is claimed is:

1. A method for stabilizing a source location during discharge plasma-based generation of extreme ultraviolet radiation comprising the steps of:

providing a vaporization beam of pulsed high-energy radiation by means of a pulsed high-energy radiation source;

directing the vaporization beam via a first beam aligning unit, a beam focusing unit and a second beam aligning unit, to a predetermined vaporization location for vaporizing emitter material between two electrodes arranged in a vacuum chamber;

acquiring first actual direction values in two coordinates from the vaporization beam by means of a first measuring device coupled with the vaporization beam via a first beamsplitter prior to the vaporization beam's impingement on the first beam aligning unit;

determining and storing first direction deviations of the vaporization beam in a storage unit by comparing the first actual direction values with first reference direction values;

correcting a second beam aligning unit in two coordinates to compensate for the first direction deviations of the vaporization beam;

acquiring second actual direction values in two coordinates from the vaporization beam by means of a second measuring device coupled with/to the vaporization beam via a second beamsplitter downstream of the first beam aligning unit;

determining and storing second direction deviations of the vaporization beam in the storage unit with respect to the predetermined vaporization location's direction by comparing the second actual direction values with second reference direction values;

correcting the first beam aligning unit in two coordinates to compensate for the second direction deviations of the vaporization beam;

acquiring actual divergence values from the vaporization beam by means of a third measuring device coupled with/to the vaporization beam via a third beamsplitter downstream of the first beam aligning unit;

determining and storing divergence deviations of the vaporization beam in the storage unit, via a third measuring device, by comparing the actual divergence values with reference divergence values for which the vaporization beam is focused into the predetermined vaporization location along a corrected direction of the vaporization beam; and correcting the beam focusing unit to compensate for the divergence deviations of the vaporization beam to adjust the focusing of the vaporization beam at the predetermined vaporization location.

2. The method of claim 1, further comprising:

supplying several values of electric input power to the radiation source, for each of the several, determining and storing in the storage unit, for the first beam aligning unit, for the second beam aligning unit, and for the beam focusing unit, correction settings at which, the first actual direction values are the first reference direction values, the second actual direction values are the second reference direction values, and the actual divergence values are the reference divergence values;

wherein, when one of the several values of electric input power is supplied to the radiation source, the respective stored correction settings are capable of being retrieved and used for correction.

3. The method of claim 2, wherein selecting of one of the several values of electric input power supplied to the radiation source causes automatic retrieval and application of its respective stored correction settings as basic settings for the first beam aligning unit, for the second beam aligning unit, and for the focusing unit.

4. The method of claim 1, further comprising for each of several values of electric input power supplied to a radiation source, determining and storing sensor correction settings for position-sensitive sensors used for acquiring the first actual direction values, the second actual direction values, and the actual divergence values, wherein, when one of the several values of electric input power is supplied to the radiation source, the respective stored sensor correction settings are capable of being retrieved and used for sensor correction.

5. The method of claim 4, wherein selecting of one of the several values of electric input power supplied to the radiation source causes automatic retrieval and application of its respective stored sensor correction settings for basic settings of the position-sensitive sensors.

6. The method of claim 1, wherein the vaporization beam is focused at the predetermined vaporization location on one of the two electrodes on which the emitter material is supplied.

7. The method of claim 6, wherein the emitter material is moved through the predetermined vaporization location.

8. The method of claim 1, wherein the vaporization beam is focused at the predetermined vaporization location between the two electrodes, and further comprising regularly injecting drops of the emitter material into the predetermined vaporization location.

9. The method of claim 1, further comprising monitoring a distance between the predetermined vaporization location and at least one reference point by an optical distance monitoring device.

10. A system for stabilizing a source location during discharge plasma-based generation of extreme ultraviolet radiation, comprising:

a pulsed high-energy radiation source for generating a vaporization beam;

a beam focusing unit for focusing the vaporization beam at a predetermined vaporization location for vaporization of emitter material between two electrodes using gas discharge in a vacuum chamber;

a first beam aligning unit being arranged behind the beam focusing unit in a path of the vaporization beam;

a second beam aligning unit being arranged in front of the beam focusing unit in the path of the vaporization beam;

a storage/control unit;

an adjusting means for adjusting a position and an orientation of the second beam aligning unit;

a first measuring device, that is connected to the storage/control unit and to the adjusting means of the second beam aligning unit, for acquiring deviations of the vaporization beam's direction with respect to the focusing unit;

a first beam splitter being arranged in the vaporization beam's path upstream the second beam aligning unit for coupling out a first beam component of the vaporization beam to the first measuring device;

an adjusting means for adjusting a position and an orientation of the first beam aligning unit;

a second measuring device, connected to the storage/control unit and to the adjusting means of the first beam aligning unit, for acquiring deviations of the vaporization beam's direction focused at the predetermined vaporization location from reference values with respect to the vaporization location's direction;

a second beam splitter being arranged in the vaporization beam's path downstream the first beam aligning unit for coupling out a second beam component of the vaporization beam to the second measuring device;

an adjusting means for adjusting the beam focusing unit;

a third measuring device, connected to the storage/control unit and to the adjusting means for adjusting the beam focusing unit, for acquiring divergence deviations of the vaporization beam focused at the predetermined vaporization location from reference divergence values with respect to the vaporization location's direction; and a third beam splitter being arranged in the vaporization beam's path downstream the first beam aligning unit for coupling out a third beam component of the vaporization beam to the third measuring device;

wherein the first beam aligning unit, the second beam aligning unit, the beam focusing unit, the first beam splitter, the second beam splitter, and the third beam splitter are fixedly mechanically connected to the vacuum chamber.

11. The system of claim 10, wherein the second beam aligning unit is a two-dimensionally adjustable direction manipulator of the radiation source of pulsed high-energy radiation, and wherein the first beam aligning unit is a two-dimensionally adjustable beam deflecting unit.

12. The system of claim 10, wherein the first beam aligning unit and the second beam aligning unit are two-dimensionally adjustable beam deflecting units.

13. The system of claim 10, wherein the first measuring device and the second measuring device are position-sensitive radiation sensors detecting a positional deviation as an equivalent measured quantity for acquiring direction deviation from a reference direction value.

14. The system of claim 13, wherein each of the position-sensitive radiation sensors is a receiver unit chosen from the group of matrix detector, quadrant detector, a combination of two bi-cell detectors orthogonal to one another, or a combination of two line detectors orthogonal to one another.

15. The system of claim 10, wherein the third measuring device comprises:

an aperture mirror having a central aperture, wherein the third beam component coupled out of the vaporization beam is directed to the central aperture, a first divergence sensor detecting radiation passing the aperture of the aperture minor, and a second divergence sensor detecting radiation of the third beam component reflected by the aperture mirror.

16. The system of claim 10, wherein the second beam splitter is a rotating laser window in the vaporization beam's path, and wherein beam components of the vaporization beam are coupled out at least periodically onto the second measuring device and onto the third measuring device through the second beam splitter.

* * * * *